US012590555B2

(12) United States Patent
Jarelius et al.

(10) Patent No.: US 12,590,555 B2
(45) Date of Patent: Mar. 31, 2026

(54) METHOD AND CONTROL ARRANGEMENT FOR CONTROLLING OPERATION OF A FAN IN A COOLING SYSTEM OF A VEHICLE

(71) Applicant: Scania CV AB, Södertälje (SE)

(72) Inventors: Sofie Jarelius, Huddinge (SE); Robert Gröning, Vagnhärad (SE); Martin Hansson, Stockholm (SE)

(73) Assignee: Scania CV AB, Södertälje (SE)

( * ) Notice: Subject to any disclaimer, the term of this patent is extended or adjusted under 35 U.S.C. 154(b) by 0 days.

(21) Appl. No.: 18/676,996

(22) Filed: May 29, 2024

(65) Prior Publication Data

US 2024/0410310 A1 Dec. 12, 2024

(30) Foreign Application Priority Data

Jun. 9, 2023 (SE) ..... 2350701-5

(51) Int. Cl.
*F01P 7/04* (2006.01)

(52) U.S. Cl.
CPC ..... *F01P 7/048* (2013.01); *F01P 2025/40* (2013.01); *F01P 2025/60* (2013.01)

(58) Field of Classification Search
CPC ..... F01P 7/048; F01P 2025/40; F01P 2025/60
See application file for complete search history.

(56) References Cited

U.S. PATENT DOCUMENTS 5,359,969 A 11/1994 Dickrell et al.
9,523,306 B2 12/2016 Dickerson
2005/0081801 A1 4/2005 Braun et al.
2007/0221166 A1* 9/2007 Kemmner ..... F01L 1/34 123/324
2012/0227379 A1* 9/2012 Koestler ..... F01N 3/023 60/311
2019/0170048 A1* 6/2019 Li ..... F01N 11/00
(Continued)

FOREIGN PATENT DOCUMENTS

CN 116006312 A 4/2023
DE 102005047139 A1 4/2006
(Continued)

OTHER PUBLICATIONS

"Nick Nearwood, On Properly Setting Your Cooling Fan Temperature Threshold, 2019, https://nearwood.dev/on-properly-setting-your-cooling-fan-temperature-threshold/" (Year: 2009).*
(Continued)

*Primary Examiner* — Kurt Philip Liethen
(74) *Attorney, Agent, or Firm* — Moore & Van Allen PLLC; W. Kevin Ransom

(57) ABSTRACT

A method and control arrangement for controlling operation of a fan in a cooling system of a vehicle, wherein operation of the fan is controlled based on a temperature of a coolant in the coolant system meeting a set-temperature of the coolant. The method comprises monitoring an engine oil temperature of an engine of the vehicle during a plurality of driving cycles with the vehicle; and adjusting the set-temperature of the coolant based on a measure indicative of a plurality of maximum temperatures of the engine oil during the plurality of driving cycles.

17 Claims, 4 Drawing Sheets

(56) References Cited

U.S. PATENT DOCUMENTS

| | | | | |
|---|---|---|---|---|
| 2020/0109680 | A1* | 4/2020 | Hashimoto | F02D 41/126 |
| 2020/0284480 | A1* | 9/2020 | Tolouei Asbforoushani | F25B 25/005 |

FOREIGN PATENT DOCUMENTS

| | | | |
|---|---|---|---|
| EP | 1741893 | A1 | 1/2007 |
| EP | 2715085 | A2 | 4/2014 |
| WO | 2011005171 | A1 | 1/2011 |
| WO | 2012152913 | A2 | 11/2012 |

OTHER PUBLICATIONS

Scania CV AB, Swedish Patent Application No. 2350701-5, Office Action, Jan. 15, 2024.
Scania CV AB, Swedish Patent Application No. 2350701-5, Office Action, Mar. 28, 2025.
Scania CV AB, German Patent Application No. 10 2024 115 046.7, Office Action, Jul. 30, 2025.
Nearwood, N., "On properly setting your cooling fan temperature threshold," Mar. 8, 2015, https://nearwood.dev/on-properly-setting-your-cooling-fan-temperature-threshold.

* cited by examiner

METHOD AND CONTROL ARRANGEMENT FOR CONTROLLING OPERATION OF A FAN IN A COOLING SYSTEM OF A VEHICLE

CROSS-REFERENCE TO RELATED APPLICATIONS

This application claims priority to Swedish Patent Application No. 2350701-5 filed Jun. 9, 2023, of the same title; the contents of which are hereby incorporated by reference.

TECHNICAL FIELD

The present disclosure relates to a method and a control arrangement for controlling operation of a fan in a cooling system of a vehicle. The disclosure also relates to a cooling system comprising the control arrangement, and a vehicle comprising the cooling system.

BACKGROUND

A vehicle engine produces a lot of heat during operation and must be cooled continuously to avoid engine damage. This is typically done by circulating a coolant through dedicated cooling passages in the engine. Hot coolant is pumped out from the cooling passages in the engine to a radiator, where the coolant exchanges heat with the surrounding air and is cooled down before it is returned to the engine. A fan may be used to provide an airflow through the radiator to cool it adequately. The fan may be connected to and driven by a crankshaft of the engine or may be electrically driven. A valve, for example a thermostat, is used to direct the flow of coolant to either bypass the radiator or to flow through the radiator based on a predetermined temperature of the coolant. The fan is typically actuated when the temperature of the coolant is above a certain set-temperature, i.e., the predetermined temperature of the coolant for controlling the valve, or slightly higher. However, such a solution may give an unnecessarily low temperature of the engine and an unnecessarily high use of the fan. Since using the fan means loss of energy, and, if driven via the crankshaft, means a loss of torque for the engine, it is desired to use the fan as little as possible to save energy.

SUMMARY

It is an objective of the present disclosure to provide a solution for improving the performance of a motor vehicle. It is a further objective to provide a solution for optimizing cooling of a vehicle engine in terms of energy consumption and/or wear.

These objectives and others are at least partly achieved by the method, control arrangement, cooling system and vehicle according to the independent claims, and by the embodiments according to the dependent claims.

According to a first aspect, the disclosure relates to a method for controlling operation of a fan in a cooling system of a vehicle, wherein operation of the fan is controlled based on a temperature of a coolant in the coolant system meeting a set-temperature of the coolant. The method comprises monitoring an engine oil temperature of an engine of the vehicle during a plurality of driving cycles with the vehicle and adjusting the set-temperature of the coolant based on a measure indicative of a plurality of maximum temperatures of the engine oil during the plurality of driving cycles.

The present method provides a more optimal and tailorized use of the fan than previous solutions, by considering maximum temperatures of the engine oil during a plurality of previous driving cycles. The maximum temperatures of the engine oil are indicative of how intense the most intensive operating conditions for the engine of the vehicle engine are, and the cooling can thereby be adapted for each vehicle. Thereby a better balance between energy use and wear can be obtained, and typically unnecessary cooling can be avoided. By using maximum temperatures from a plurality of previous driving cycles, a more robust adjustment can be made.

According to some embodiments, the adjusting comprises adjusting the set-temperature based on the correspondence of the measure with a set of thresholds indicative of desired engine oil temperature. Thereby, the temperature of the coolant can be controlled to better suit the operating conditions of the vehicle and thus the engine.

According to some embodiments, the adjusting comprises at least one of: decreasing the set-temperature upon the measure being greater than an upper threshold of the set of thresholds, wherein a measure greater than the upper threshold is indicative of increased intensity vehicle operating condition; increasing the set-temperature upon the measure being below a lower threshold of the set of thresholds, wherein a measure below the lower threshold is indicative of decreased intensity vehicle operating conditions; and maintaining the set-temperature upon the measure being within or on an interval delimited by the upper threshold and the lower threshold. Thereby, the set-temperature will not be adjusted for smaller changes in the measure to prove robust control.

According to some embodiments, the decreasing comprises decreasing the set-temperature based on a size of the exceedance of the measure of the upper threshold. The control can then be made faster and more stable.

According to some embodiments, the increasing comprises increasing the set-temperature based on a size of the undershoot of the measure of the lower threshold. The control can then be made faster and more stable.

According to some embodiments, the method comprises determining the measure indicative of a plurality of maximum temperatures during the plurality of driving cycles.

According to some embodiments, the determining comprises determining the measure based on engine oil temperatures fulfilling one or more predetermined conditions, in particular being measured after the vehicle reaching at least a minimum of mileage and/or a minimum velocity and/or being measured while the fan is being operated. Thereby, measurement data that relates to, for example, start-up or idling, or measurement data that for other reasons could compromise the result of the method, can be discarded.

According to some embodiments, the measure is an average of at least one maximum value from each driving cycle of the plurality of driving cycles. A more robust method can then be obtained.

According to some embodiments, the measure is an average of a single maximum value from each of the plurality of driving cycles. Each and every driving cycle can then be reflected.

According to some embodiments, a maximum value is a temperature value over a certain predetermined engine oil temperature. A plurality of maximum values can then be obtained from a single driving cycle, which may reflect an intensity of the driving cycle.

According to some embodiments, a driving cycle is defined as a time period from the engine of the vehicle is turned on until it is turned off. A driving cycle may alternatively be defined as a series of data points representing the speed of the vehicle versus time. A driving cycle should include an intended operation of the vehicle.

According to some embodiments, the method comprises adjusting one or more thresholds of the set of thresholds and/or the set-temperature based on a user input. A user such as a service technician can thus manually change the settings to more accurately impact life length, service intervals and fuel economy according to the intended use of the vehicle.

According to some embodiments, the method comprises obtaining an indication of a time to service of the engine of the vehicle and/or a soot estimation value above a certain threshold, and as a result increasing the set-temperature. The engine oil shall then nevertheless soon be changed and a higher temperature can be allowed, whereby fuel consumption can be saved by not using the fan.

According to some embodiments, the method comprises determining an available cooling capacity of the cooling system and adjusting a gain of a controller configured to control the fan based on the determined available cooling capacity. It is thereby possible to reach a desired set-temperature of the engine oil with better accuracy.

According to some embodiments, the method comprises determining an available cooling capacity of the cooling system based on at least one of: a difference between a coolant temperature and ambient temperature, radiator size of cooler in cooling system, fan type, and/or fan size.

According to some embodiments, the method comprises controlling operation of the fan to minimize a difference between a current measure of the temperature of the coolant and the set-temperature.

According to a second aspect, the disclosure relates to a computer program comprising instructions which, when the computer program is executed by a computer, cause the computer to carry out the method according to the first aspect. The same advantages as have been described above with regards to the first aspect are thereby achieved.

According to a third aspect, the disclosure relates to a computer-readable medium comprising instructions which, when executed by a computer, cause the computer to carry out the method according to the first aspect. The same advantages as have been described above with regards to the first aspect are thereby achieved.

According to a fourth aspect, the disclosure relates to a control arrangement for controlling operation of a fan in a cooling system of a vehicle, wherein operation of the fan is controlled based on a temperature of a coolant in the coolant system meeting a set-temperature of the coolant, and wherein the control arrangement is configured to monitor an engine oil temperature of an engine of the vehicle during a plurality of driving cycles with the vehicle; and adjust the set-temperature of the coolant based on a measure indicative of a plurality of maximum temperatures of the engine oil during the plurality of driving cycles. The same advantages as have been described above with regards to the first aspect are thereby achieved.

According to a fifth aspect, the disclosure relates to a cooling system for a vehicle, wherein the cooling system comprises a fan, a cooling circuit configured to circulate a coolant, and a control arrangement according to the fourth aspect. The same advantages as have been described above with regards to the first aspect are thereby achieved.

According to a sixth aspect, the disclosure relates to a vehicle comprising the cooling system according to the fifth aspect. The same advantages as have been described above with regards to the first aspect are thereby achieved.

BRIEF DESCRIPTION OF THE DRAWINGS

The embodiments disclosed herein are illustrated by way of example, and not by way of limitation, in the figures of the accompanying drawings. Like reference numerals refer to corresponding parts throughout the drawings, in which.

DETAILED DESCRIPTION

An engine should have a certain temperature to run most efficiently. If it is too cold, unnecessary friction may arise, which means waste of fuel and an increased risk of wear. If it is too warm, parts may start melting and the engine is likely destroyed. A coolant system in the vehicle assures that the engine has a certain temperature to run efficiently. The coolant system controls the temperature of a coolant that circulates to the engine and cools inter alia the engine oil. As the engine oil circulates in the engine, the temperature of the engine oil is also a good estimate of the temperature of the engine. A fan used for cooling the coolant is typically actuated when the temperature of the coolant is above the set-temperature of the coolant, and the coolant is circulating to the cooler in the coolant system. Conventionally, the set-temperature has been set to a constant value according to a worst-case scenario. Since using the fan means a loss of torque for the engine, from a fuel consumption perspective, the fan should be used as little as possible. Current solutions often give rise to an unnecessarily low temperature being maintained and therefore an unnecessarily high use of the fan.

The inventors of the present invention have realized that the use of the fan can be optimized by considering maximum temperatures of the engine oil over a plurality of driving cycles and adjusting the set-temperature of the coolant accordingly. Since the fan is controlled based on the set-temperate, as will be explained in greater detail below, this means that the operation of the fan will be adjusted as well. Typically, the fan is controlled to cool the coolant such that the temperature of the coolant is as close as possible to the set-temperature of the coolant. However, instead of having a constant set-temperature of the coolant, the set-temperature is adjusted based on maximum values of the engine oil achieved during historical driving of the vehicle. The maximum values form the basis for a measure, for example an average, of a plurality of maximum temperatures of the engine oil during a plurality of driving cycles. The maximum temperatures of the engine oil are indicative of how intense the most intensive operating conditions of the engine of the vehicle have been, and the cooling can thereby be customized for each vehicle. By using maximum temperatures from a plurality of previous driving cycles, a more robust adjustment can be made. The set-temperature of the coolant then becomes better fitted to the vehicle at hand and its specific operating conditions.

In the following, embodiments of the invention will be described in more detail with reference to the figures.

Figure 1:
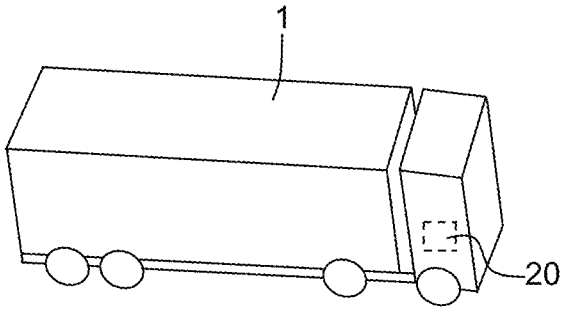
FIG. 1 illustrates an exemplary vehicle comprising a cooling system according to some embodiments of the disclosure.

FIG. 1 illustrates an exemplary vehicle 1 comprising a cooling system 20 according to some embodiments of the disclosure. Vehicle 1 is for example a commercial vehicle such as a truck, a trailer, a lorry, a bus, a boat or similar.

Vehicle 1 may alternatively be a passenger car or a passenger boat or similar. Vehicle 1 may be constructed for a specific purpose, for example mining, excavating, service etc. The cooling system 20 is typically configured for the vehicle and its purpose. For example, a vehicle intended for mining may need a cooling system 20 with a great cooling capacity. The cooling system 20 is arranged for cooling the engine of vehicle 1. The cooling system 20 may also be used for cooling a generator set, i.e., a genset.

Figure 2:
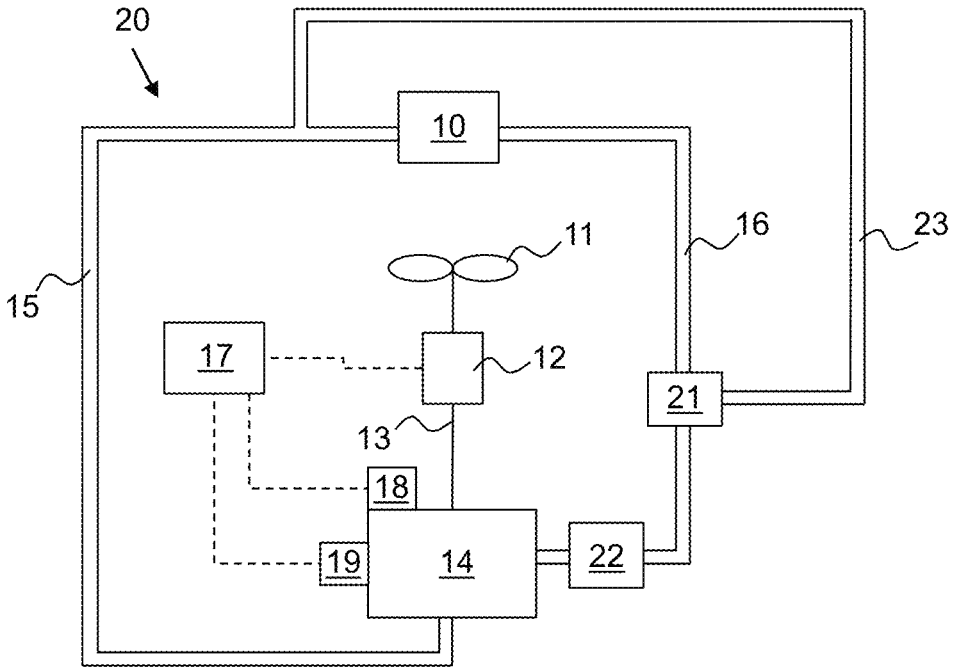
FIG. 2 illustrates a subsystem of the vehicle in FIG. 1 according to some embodiments of the disclosure.

FIG. 2 illustrates a subsystem of vehicle 1 according to some embodiments of the disclosure. The subsystem comprises a cooling system 20 and an engine 14 of vehicle 1. The engine 14 is for example a combustion engine. The cooling system 20 comprises a fan 11, a cooling circuit 15, 16 configured to circulate a coolant, and a control arrangement 17. The cooling system 20 also comprises a cooler 10 which includes one or more radiators. The cooling circuit 15, 16 comprises a first line 15 and a second line 16. The first line 15 is configured to circulate the coolant from the cooler 10 to the engine 14 in order to cool the engine 14. The coolant is typically circulated through engine 14 via internal and/or external lines (not shown) to cool the engine 14. The second line 16 is configured to circulate the coolant from engine 14 back to the cooler 10. The cooling system 20 further comprises a bypass line 23 arranged between the second line 16 and the first line 15. The bypass line 23 is fluidly connected between the second line 16 and the first line 15. Bypass line 23 is thus arranged to bypass cooler 10. The coolant is thus flowing in a closed system including the cooling circuit 15, 16, the cooler 10, the bypass line 23 and the engine 14. The coolant is typically circulated in the closed system by means of a pump 22. In one embodiment, pump 22 is arranged in the second line 16. The pump 22 is, for example, driven by the engine belt (not shown) of engine 14. The coolant is a fluid, typically a liquid, adapted to cool the engine. The coolant is for example a mixture of water and glycol.

The cooling system 20 also comprises a valve 21. The valve 21 is for example a thermostat. The valve 21 is arranged in the second line 16 between engine 14 and the cooler 10, typically downstream the pump 22. Valve 21 is arranged to selectively direct the flow of coolant in the second line 16 from the engine 14 to either the cooler 10 or to the bypass line 23 and further to the first line 15. The valve 21 is controlled based on a predetermined temperature of the coolant. When the temperature of the coolant is below the predetermined temperature, valve 21 directs the flow of coolant in the second line 16 into the bypass line 23 to the first line 15 whereby cooler 10 is bypassed. When the temperature of the coolant is at or above the predetermined temperature, valve 21 directs the coolant to cooler 10. Hence, valve 21 blocks the flow of coolant from the engine 14 to the cooler 10 until the engine 14 has warmed up. The coolant then typically bypasses the cooler 10 and is circulated to the engine directly 14. When the coolant has reached the predetermined temperature, valve 21 blocks the flow of coolant via the bypass line 23 and directs the flow of coolant to cooler 10 to cool the coolant. Thereby engine 14 can warm up as quickly as possible, and engine wear, deposits, friction, and emissions are reduced.

At least one radiator of cooler 10 is configured to use air from the surroundings to cool the coolant in the closed system described above. Fan 11 is configured to be driven by a crankshaft 13 of engine 14. A coupling 12 is configured to connect the crankshaft 13 and the fan 11. Coupling 12 is for example a clutch, e.g., an electromagnetic clutch or an electromechanical clutch. Control arrangement 17 is configured to control the operation of fan 11 by sending control signals to the coupling 12. Coupling 12 is configured to receive the control signals from the control arrangement 17 and to regulate the fan 11 based thereon. In some embodiments, the coupling 12 may have an engagement ratio that is variable. Hence, fan 11 may then be operated at variable speed. Alternatively, fan 11 is electronically driven, powered from a battery via a control unit (not shown). Fan 11 may then also be operated at variable speed. A temperature sensor 18 is arranged to monitor the temperature of the coolant. The temperature sensor 18 is typically immersed into the coolant to measure its temperature. The control arrangement 17 is arranged to receive the temperature of the coolant from the temperature sensor 18. The control arrangement 17 is configured to send a control signal to the coupling 12 or control unit to activate the fan 11 upon the temperature of the coolant going above a set-temperature of the coolant. The set-temperature of the coolant is the desired temperature of the coolant. The speed of fan 11 is typically controlled based on the set-temperature of the coolant. The control arrangement 17 is further configured to send a control signal to the coupling 12 or control unit to de-activate the fan 11 upon the temperature of the coolant being equal to or going below the set-temperature of the coolant. As long as the temperature of the coolant is above the set-temperature, fan 11 is operated. Hence, the set-temperature of the coolant determines when and optionally how fan 11 is being operated, with the aim of reducing the difference between a current measure of the temperature of the coolant temperature and the set-temperature. The set-temperature is typically saved in a memory of the control arrangement 17. In some embodiments, fan 11 may be operated at variable speed. Hence, operating the fan 11 may include any of activating the fan 11, deactivating the fan 11, increasing the speed of the fan 11, decreasing the speed of the fan 11 or controlling the speed of the fan 11 to a constant speed, in order to meet the set-temperature of the coolant.

In the present disclosure, the control arrangement 17 is configured to adjust the set-temperature based on maximum temperatures of the oil temperature of the engine. A temperature sensor 19 is arranged to sense the temperature of the engine oil itself. The temperature sensor 19 is for example arranged to sense the temperature of the engine oil downstream an oil cooler where the engine oil and coolant exchanges heat. In most engines, engine oil is pumped though the engine block and other components such as the cylinder head and bearings, to lubricate and cool the moving parts of the engine. As oil circulates through the engine, it absorbs heat from the engine components, causing its temperature to rise. The temperature sensor 19 is typically designed to measure the temperature of the oil as it leaves the engine block or oil pan and returns to the oil cooler or oil filter. The temperature sensor 19 is for example a thermistor. Some engines may include more than one temperature sensor 19 arranged to sense the temperature of the engine oil.

Figure 3:
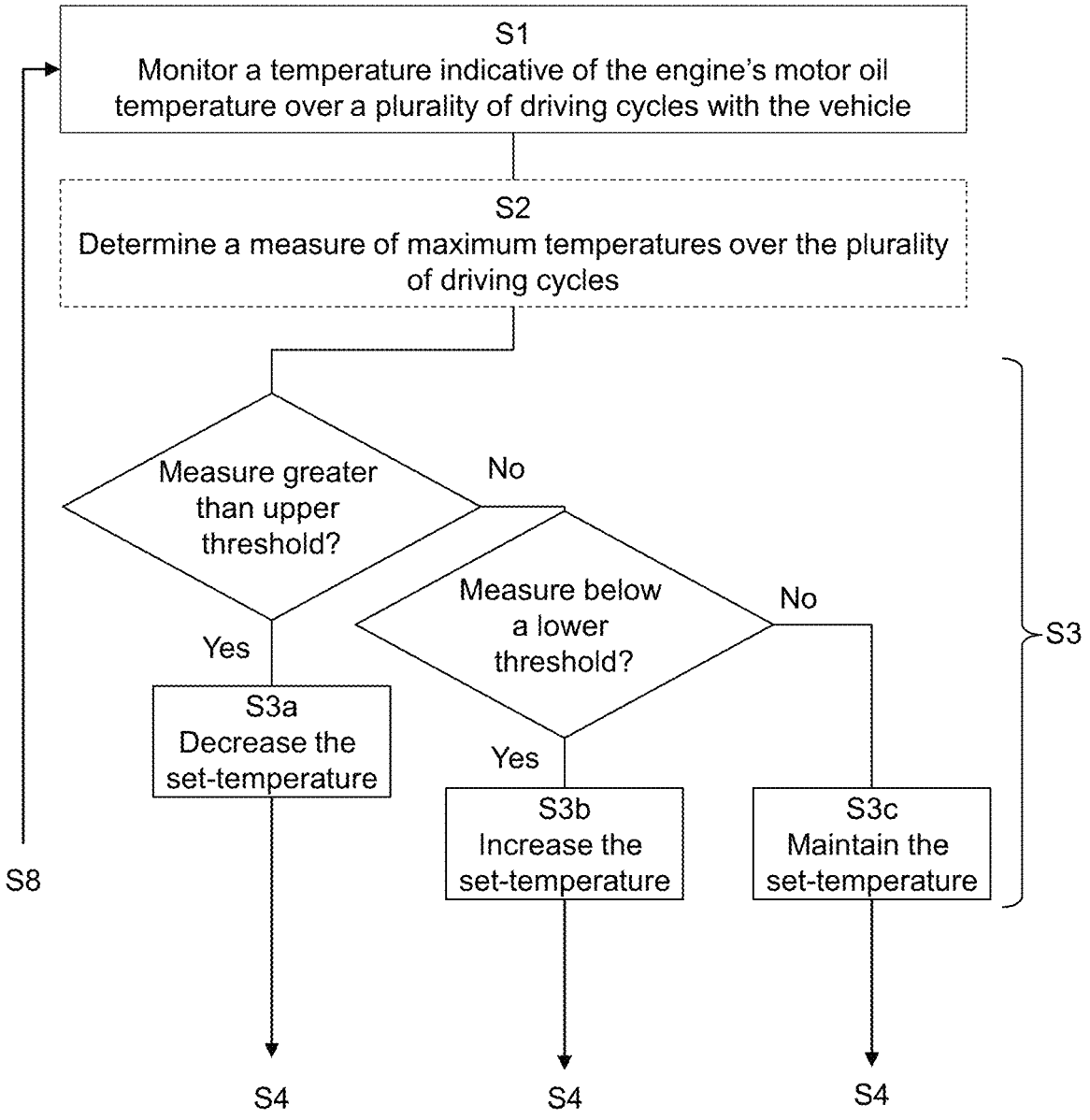
FIGS. 3 to 4 is a flowchart of a method according to some embodiments of the disclosure.
Figure 4:
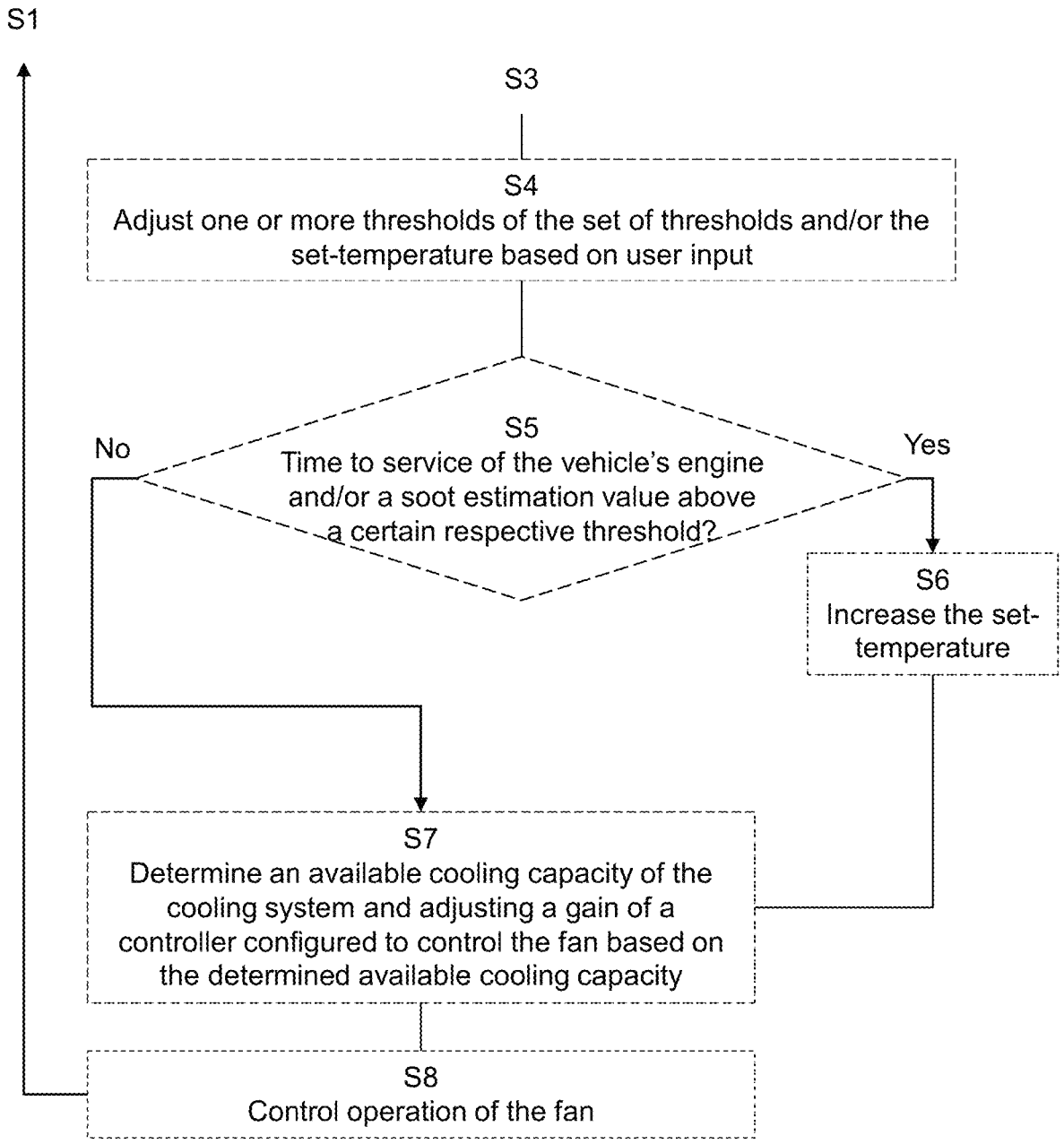

In the following a method for controlling operation of a fan 11 in a cooling system 20 of a vehicle 1 will be explained with reference to the flow charts in FIGS. 3-4 and the diagram in FIG. 5. The method may be implemented as a computer program and saved in a memory 17*a* of a control arrangement 17 (FIG. 6). When executed by a processor 17*b*, the method is automatically performed in the vehicle 1. The method is typically continuously or repeatedly performed.

The operation of the fan 11 is controlled based on a temperature of a coolant in the coolant system 20 meeting a set-temperature of the coolant. Typically, the fan 11 is being operated when the temperature of the coolant is above a set-temperature of the coolant. When the temperature of the coolant is equal to or goes below the set-temperature, the fan 11 is stopped or its speed is decreased. It is typically desired that the temperature of the coolant is as close as possible to the set-temperature. Hence, a fan controller then controls the fan to minimize a difference between the temperature of the coolant temperature and the desired set-temperature of the coolant. The temperature of the coolant may be allowed to vary within a small interval, such control may be referred to as control with hysteresis. The fan controller may be implemented as a P-controller where P stands for proportional control. Input to the P-controller is the set-temperature of the coolant and the temperature of the coolant, where the P-controller minimizes the difference between the set-temperature of the coolant and the temperature of the coolant. The output from the fan controller is a control signal to the coupling 12 or control unit to either activate or deactivate the fan, and possibly set a speed of the fan 11. In other words, in some embodiments the method comprises controlling operation S8 of the fan 11 to minimize a difference between a current measure of the temperature of the coolant and the set-temperature of the coolant. The temperature of the coolant is for example measured using a temperature sensor 18 as previously explained with reference to FIG. 2. Typically, the set-temperature is initially set by a technician at a factory or service point based on a worst-case scenario before vehicle 1 is being delivered to the user. It is however also contemplated that the set-temperature may be set by the user of the vehicle as well.

To tailorize the set-temperature of the coolant to the current vehicle 1, the method comprises adapting the set-temperature of the coolant based on the engine oil temperature. Hence, another control loop is used to control, or optimize, the set-temperature of the coolant. The engine oil temperature gives a fast and direct estimate of the temperature of the engine itself and is therefore well suited as a control input. To take temporary fluctuations into account, the engine oil temperature is monitored during a longer time period, typically during a plurality of driving cycles with the vehicle 1. In other words, the method comprises monitoring S1 an engine oil temperature of an engine 14 of the vehicle 1 during a plurality of driving cycles with the vehicle 1. The monitoring S1 may include obtaining engine oil temperatures versus time from a network bus such as a CAN (Controller Area Network) bus of the vehicle 1. The engine oil temperatures may be measured with a temperature sensor 19 configured to sense the temperature of the engine oil, as has been previously explained. In case several temperature sensors 19 are used to measure the temperature of the engine oil, the temperature measurement may be an average of the different temperatures, or a maximum value of the temperatures.

A driving cycle may be defined as a time period from the engine 14 of the vehicle 1 is turned on until it is turned off. Alternatively, the driving cycle may be defined as a certain period of time, for example 4, 8, 12, 16 or 24 hours. The driving cycle may then include a plurality of starts and stops. A driving cycle may be defined according to the working schedule of the driver, hence, according to the drivers driving time and rest periods. For example, a driving cycle may be defined to be the driving time during a day. Typically, a driving cycle should include driving the vehicle according to its intended operation. For example, if the vehicle is a mining truck, the driving cycle should include mining operation(s). The driving cycle may be started at a certain time period after the vehicle has started being operated, to avoid initial fluctuations. The driving cycle may also or alternatively be started when the temperature of the coolant or engine oil goes above a certain threshold, for example when the fan has started being operated. The driving cycle may stop at the end of the driver's driving time of a day, or when the vehicle is stopped. A driving cycle may alternatively be defined as a combination of two or more of the above-described examples.

The method further comprises determining S2 a measure indicative of a plurality of maximum engine oil temperatures during the plurality of driving cycles. Hence, the method comprises selecting the maximum temperatures from the monitored engine oil temperatures. A maximum value is for example selected as the highest engine oil temperature during a cycle. Also or alternatively, the maximum value may be an engine oil temperature where the derivative of a curve being a function of the engine oil temperature versus time is zero, and the second derivative of the curve is negative. As commonly known, a negative second derivative of a curve is indicative of a local maximum. Alternatively, all engine oil temperature values above a certain threshold are considered as maximum values. Hence, a cycle may include zero, one or a plurality of maximum engine oil temperatures. In some embodiment, the selected maximum engine oil temperatures may be used for determining a measure being an average of the maximum temperatures. An average is for example a mean, a median or a mode. A mean may be a sum of the maximum engine oil temperatures divided by the number of maximum engine oil temperatures. A median is the middle value of a sorted list of the maximum engine oil temperatures. A mode is the most common value of the maximum engine oil temperatures. In some embodiments, at least one maximum value from each driving cycle is selected. In other words, the measure is an average of at least one maximum value from each driving cycle of the plurality of driving cycles. Alternatively, a single maximum value from each driving cycle is selected. In other words, the measure is an average of a single maximum value from each of the plurality of driving cycles. Still alternatively, all engine temperatures over a certain predetermined engine oil temperature are considered as maximum engine temperatures and used for determining the measure. In other words, a maximum value is a temperature value over a certain predetermined engine oil temperature. In a further alternative, the measure is a percentage of the time the engine oil temperature is above the certain predetermined engine oil temperature.

Figure 5:
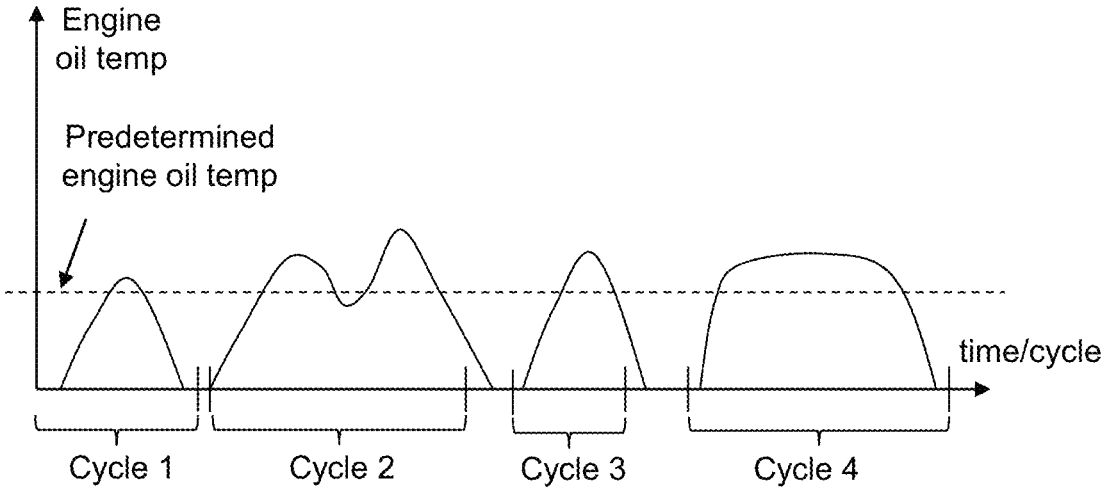
FIG. 5 is a diagram of engine oil temperatures over time according to an example embodiment.
Figure 6:
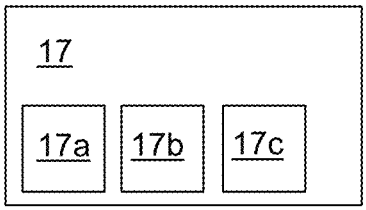
FIG. 6 illustrates a control arrangement according to some embodiments of the disclosure.

For illustrating an example of maximum values, FIG. 5 shows a diagram of engine oil temperatures over time according to an example embodiment. Four different cycles are illustrated. A dashed line illustrates a predetermined oil temperature. In some embodiments, a maximum engine oil temperature is an engine oil temperature above such predetermined engine oil temperature having a derivative of zero and a negative second derivative. As can be seen, in this example, the engine oil temperature has a derivative of zero above the predetermined engine oil temperature five times during the four cycles, and thus five maximum engine oil temperatures can be determined. A mean value may then be determined as a sum of the five maximum engine oil temperatures divided by five. Alternatively, all engine oil temperatures above the predetermined engine oil temperature are regarded as maximum engine oil temperatures. A mean value may then be determined as a sum of all the maximum engine oil temperatures, measured at time instances, divided by the number of time instances.

In some embodiments, the engine oil temperatures need to fulfil some conditions to form the basis for determining the measure. For example, the determining comprises determining the measure based on engine oil temperatures fulfilling one or more predetermined conditions, in particular being measured after the vehicle 1 reaching at least a minimum of mileage and/or a minimum velocity, and/or being measured while the fan 11 is being operated. Thereby, measurement data that relates to, for example start-up or idling, or measurement data that for other reasons could compromise the result of the method, can be discarded. For example, temporary spikes or very low temperatures during a driving cycle can be discarded.

The method further comprises adjusting S3 the set-temperature of the coolant based on the measure that is indicative of a plurality of maximum temperatures of the engine oil during the plurality of driving cycles. Thereby the set-temperature can be tailored for each vehicle and better adapted to the operating conditions for the specific vehicle at hand such that energy consumption and/or efficiency can be optimized or at least improved. In some embodiments, the adjusting S3 comprises adjusting the set-temperature based on the correspondence of the measure with a set of thresholds indicative of desired engine oil temperature. A desired engine oil temperature is typically a temperature where the engine is working most efficiently. The thresholds may define one or more intervals for the measure, and a corresponding set-temperature of the coolant. The method may include comparing the measure to the set of thresholds and adjusting the set-temperature accordingly, for example increasing or decreasing the set-temperature of the coolant. The set of thresholds is typically experimentally derived for the engine of the vehicle. The set of thresholds typically define a desired engine oil temperature, or a desired range or interval of the engine oil temperature. The set of thresholds is used to determine if the temperature of the coolant needs to be increased or decreased to make the engine oil temperature to be at the desired engine oil temperature, or at least within the desired range or interval of the engine oil temperature. As the set-temperature of the coolant often is set according to a standard setting, it may be too low or too high for the specific vehicle at hand. The vehicle may also be exposed to changing operating conditions. For example, the engine of the vehicle may be exposed to vehicle operating conditions where the engine will become very hot, or the engine of the vehicle may only be exposed to vehicle operating conditions where the engine will have a continuous low or medium temperature. The intensity of the vehicle operating conditions may depend on type of vehicle, a magnitude of an opening temperature of a valve 14 of the engine 14, a capacity of the cooling system 20 and/or driving conditions. The opening temperature of valve 14 is a predetermined temperature of the coolant at which valve 14 starts directing coolant to cooler 10. Increased intensity vehicle operating conditions may for example be achieved by mining trucks, warm climate etc. An increased intensity vehicle operating condition may be defined as an operating condition where the measure becomes higher than a desired engine oil temperature. Decreased intensity vehicle operating conditions may for example be achieved by trucks and/or busses operating in low-speed city zones, cold climate etc. A decreased intensity vehicle operating condition may be defined as an operating condition where the measure becomes lower than a desired engine oil temperature. The opening temperature of the valve may be configured to match intended intensity of the vehicle operating conditions. Also, the capacity of the cooling system may be designed to match the intended intensity of the vehicle operating conditions. The method will also encompass adjusting the set-temperature resulting from such configuration and/or designed opening temperature of the cooling system, e.g., if the intensity of the vehicle operating conditions is different from the intended intensity of the vehicle operating conditions. For example, if the measure is greater than an upper threshold, the set-temperature of the coolant shall be decreased so the fan starts at a lower cooling temperature. The intensity of the present vehicle operating condition has then been increased compared to the previous or pre-set vehicle operating condition, for example because the climate has become warmer. If the measure is lower than a lower threshold, the set-temperature of the coolant shall be increased so the fan is started at a higher cooling temperature. The intensity of the vehicle operating condition is then considered to be decreased compared to the previous or pre-set vehicle operating condition, for example because the opening temperature of the valve is low and the set-temperature of the coolant previously was set to a standard set-temperature. In other words, in some embodiments, the adjusting S3 comprises at least one of: decreasing S3*a* the set-temperature upon the measure being greater than an upper threshold of the set of thresholds, wherein a measure greater than the upper threshold is indicative of increased intensity vehicle operating conditions. Further, in some embodiments, the method comprises increasing S3*b* the set-temperature upon the measure being below a lower threshold of the set of thresholds, wherein a measure below the lower threshold is indicative of decreased intensity vehicle operating conditions. Further, in some embodiments, the method comprises maintaining S3*c* the set-temperature upon the measure being within or on an interval delimited by the upper threshold and the lower threshold. Thereby efficient and robust control may be achieved. This kind of control may be referred to as control with hysteresis, where the upper threshold and the lower threshold define a hysteresis band. The aim of the control is thus to keep the measure within the hysteresis band. The method may check the conditions S3*a*, S3*b*, and S3*c* in any order. For example, the method may, after step S1 and/or S2, start checking if the set-temperature is greater than the upper threshold. If yes, the method comprises the step of decreasing S3*a* the set-temperature. If not, the method continues with checking if the measure is below the lower threshold. If yes, the method comprises increasing S3*b* the set-temperature. If not, the measure is within the interval delimited by the upper threshold and the lower threshold. However, the method may alternatively first check if the measure is below the lower threshold, and if not, thereafter check if the measure is greater than the upper threshold. Alternatively, the method may include first checking if the measure is on or within the interval, and if not, thereafter checking if the measure is below the lower threshold or greater than the upper threshold. In some embodiments, the upper threshold is between 111°-120° C., more particularly between 113°-117° C., and more particularly 114°, 115° or 116° C. In some embodiments, the lower threshold is between 102°-110° C., more particularly between 104°-109° C., and more particularly 105°, 106°, 107° or 108° C. In some embodiments, the upper threshold is 115° C. and the lower threshold is 107° C. The interval is typically between 7-10° C. In some embodiments, the adjusting S3 comprises adjusting the set-temperature based on the correspondence of the measure with measures in a table with related set-temperatures of the coolant. Hence, the method may include determining a matching between the determined measure and the measures in the table and using the related set-temperature of the matching measure as a new set-temperature for the coolant. As understood, these intervals define desired engine oil temperatures. The set-temperature of the coolant shall however not go below the opening temperature of the valve 14, as the coolant has not started to flow to the cooler 10 before that.

The adjusting of the set-temperature may be performed step-wise. For example, if the measure exceeds the upper threshold, the set-temperature is decreased with a predetermined temperature, for example one (1) or two (2) degrees. Correspondingly, if the measure undershoots the lower threshold, the set-temperature is increased with a predetermined temperature, for example one (1) or two (2) degrees. The adjusting of the set-temperature may be proportionally performed. For example, if the measure exceeds the upper threshold to a great extent, the set-temperature may be correspondingly decreased to a great extent. In case the measure undershoots the lower threshold to a great extent, the set-temperature may be correspondingly increased to a great extent. In other words, the method comprises decreasing S3*a* the set-temperature based on a size of the exceedance of the measure of the upper threshold. Also, in some embodiment, the method comprises increasing S3*b* the set-temperature based on a size of the undershoot of the measure of the lower threshold. Alternatively, the set of thresholds may include several upper thresholds that are step-wise increasing, and/or several lower thresholds that are step-wise decreasing, and which determines correspondingly increased or decreased new set-temperatures, respectively.

A user, for example a customer, might want to choose a set-temperature and thereby more accurately impact life length, service intervals and fuel economy. The user may then, via a technician, manually adjust the set of thresholds and/or set-temperature via a user interface. Hence, in some embodiments, the method comprises adjusting S4 one or more thresholds of the set of thresholds and/or the set-temperature based on a user input. For example, for some customers it is very important with uptime and long service intervals. By choosing a low set-temperature, the engine oil will degrade more slowly, and a longer service interval can be achieved. This is typically achieved by lowering the upper threshold. The set-temperature will then be decreased at an upper threshold that is lower than before. Alternatively, or in combination, the set-temperature can be decreased in larger steps.

In some embodiments, the method comprises obtaining information from "time to service" or a soot estimation in order to raise the set-temperature near scheduled service where the interval is controlled by the growth of soot in the oil. Hence, in some embodiments, the method comprises obtaining S5 an indication of a time to service of the engine 14 of the vehicle 1 and/or a soot estimation value above a certain threshold, and as a result increasing S6 the set-temperature. This is typically achieved by simply increasing the set-temperature to a high or maximally allowed temperature of the engine oil. Thereby, in cases when the engine oil shall anyway be changed soon, a higher set-temperature can be allowed and thus save on use of the fan and thereby also save fuel.

To further improve cooling of the engine, a gain of the fan controller can be adjusted as a function of available cooling capacity. Hence, the gain "P" of the P-controller may be increased. In other words, in some embodiments, the method comprises determining S7 an available cooling capacity of the cooling system 20 and adjusting a gain of a controller configured to control the fan 11 based on the determined available cooling capacity. Thereby the set-temperature may be reached faster and with a higher accuracy. The cooling capacity may be quantified as a delta temperature between the temperature of the coolant and the ambient temperature, radiator size, fan type/size etc. In other words, in some embodiments, the method comprises determining S7 an available cooling capacity of the cooling system 20 based on at least one of: a difference between a coolant temperature and ambient temperature, radiator size of cooler 10 in cooling system 20, fan type and/or fan size. The ambient temperature is typically available on the CAN bus, measured with one or more temperature sensors in the vehicle (not shown).

The method may be performed with a control arrangement 17, see FIG. 6, for controlling operation of a fan 11 in a cooling system 20 of a vehicle 1, wherein the control arrangement 17 is configured to perform the method as previously explained. The control arrangement 17 may be embodied as one or more ECUs (Electronic Control Units) in vehicle 1. The control arrangement 17 comprises a memory 17*a*, a processor 17*b* and a communication interface 17*c*. Memory 17*a* comprises one or more memory modules. Processor 17*b* comprises one or more processors. The communication interface 17*c* is configured to send signals and/data to various entities in vehicle 1, and to receive signals and/or data from various entities in vehicle 1. For example, via a CAN (Controller Area Network) in vehicle 1. The memory 17*a* may store a computer program comprising instructions which, when the computer program is executed by a computer, cause the computer to carry out the method according to any one of the aspects, examples and/or embodiments herein. The computer program may also be stored in a computer-readable medium. The computer-readable medium comprises instructions which, when executed by a computer, cause the computer to carry out the method according to any one of the aspects, examples and/or embodiments herein.

The computer could be comprised in the control arrangement 17. A computer may be defined as any hardware or hardware/firmware device implemented using processing circuity such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, an application-specific integrated circuit, or any other device capable of electronically performing operations in a defined manner. In some embodiments, the computer-readable medium may be a non-transitory computer-readable medium, such as a tangible electronic, magnetic, optical, infrared, electromagnetic, and/or semiconductor system, apparatus, and/or device. The invention also relates to a computer readable medium storing instructions for executing a method for controlling operation of a fan 11 in a cooling system 20 of a vehicle, wherein operation of the fan 11 is controlled based on a temperature of a coolant in the coolant system 20 meeting a set-temperature of the coolant, the method comprising monitoring S1 an engine oil temperature of an engine 14 of the vehicle 1 during a plurality of driving cycles with the vehicle 1 and adjusting S3 the set-temperature of the coolant based on a measure indicative of a plurality of maximum temperatures of the engine oil during the plurality of driving cycles. The computer program product may be a computer readable medium. The computer program may be stored in a computer readable medium.

According to some embodiments, the disclosure relates to a computer readable medium storing instructions for executing the method for controlling operation of a fan 11 in a cooling system 20 of a vehicle, and to any other aspect, embodiment or example of the method as explained herein.

The terminology used in the description of the embodiments as illustrated in the accompanying drawings is not intended to be limiting of the described method, control arrangement or computer program. Various changes, substitutions and/or alterations may be made, without departing from disclosure embodiments as defined by the appended claims.

The term "or" as used herein, is to be interpreted as a mathematical OR, i.e., as an inclusive disjunction; not as a mathematical exclusive OR (XOR), unless expressly stated otherwise. In addition, the singular forms "a", "an" and "the" are to be interpreted as "at least one", thus also possibly comprising a plurality of entities of the same kind, unless expressly stated otherwise. It will be further understood that the terms "includes", "comprises", "including" and/or "comprising", specifies the presence of stated features, actions, integers, steps, operations, elements, and/or components, but do not preclude the presence or addition of one or more other features, actions, integers, steps, operations, elements, components, and/or groups thereof. A single unit such as e.g. a processor may fulfil the functions of several items recited in the claims.

The present disclosure is not limited to the above-described preferred embodiments. Various alternatives, modifications and equivalents may be used. Therefore, the above embodiments should not be taken as limiting the scope of the disclosure, which is defined by the appending claims.

The invention claimed is:

1. A method for controlling operation of a fan in a cooling system of a vehicle, wherein operation of the fan is controlled based on a temperature of a coolant in the coolant system of the vehicle meeting a set-temperature of the coolant, the method comprising:

monitoring, while the vehicle is operating, an engine oil temperature of an engine of the vehicle during a plurality of selected driving cycles of the vehicle;

determining a measure indicative of a plurality of maximum engine oil temperatures monitored during the plurality of driving cycles of the vehicle; and adjusting the set-temperature of the coolant for use in subsequent operation of the vehicle based on the measure indicative of a plurality of maximum temperatures of the engine oil monitored during the plurality of driving cycles of the vehicle.

2. The method according to claim 1, wherein the adjusting comprises adjusting the set-temperature based on the correspondence of the measure indicative of a plurality of maximum engine oil temperatures with a set of thresholds indicative of desired engine oil temperature.

3. The method according to claim 2, wherein the adjusting comprises at least one of:

decreasing the set-temperature upon the measure indicative of a plurality of maximum engine oil temperatures being greater than an upper threshold of the set of thresholds, wherein a measure greater than the upper threshold is indicative of increased intensity vehicle operating conditions;

increasing the set-temperature upon the measure indicative of a plurality of maximum engine oil temperatures being below a lower threshold of the set of thresholds, wherein a measure below the lower threshold is indicative of decreased intensity vehicle operating conditions; and maintaining the set-temperature upon the measure indicative of a plurality of maximum engine oil temperatures being within or on an interval delimited by the upper threshold and the lower threshold.

4. The method according to claim 1, comprising determining the measure indicative of a plurality of maximum engine oil temperatures based on engine oil temperatures fulfilling one or more predetermined conditions.

5. The method according to claim 1, wherein the measure indicative of a plurality of maximum engine oil temperatures is an average of at least one maximum value from each driving cycle of the plurality of driving cycles.

6. The method according to claim 5, wherein the measure indicative of a plurality of maximum engine oil temperatures is an average of a single maximum value from each of the plurality of driving cycles.

7. The method according to claim 5, wherein the at least one maximum value is a temperature value exceeding a certain predetermined engine oil temperature.

8. The method according to claim 2, comprising adjusting one or more thresholds of the set of thresholds and/or the set-temperature based on a user input.

9. The method according to claim 1, comprising:

obtaining an indication of a time to service of the engine of the vehicle and/or comprising obtaining an indication of a soot estimation value above a certain threshold; and as a result, increasing the set-temperature.

10. The method according to claim 1, comprising:

determining an available cooling capacity of the cooling system; and adjusting a gain of a controller configured to control the fan based on the determined available cooling capacity.

11. The method according to claim 1, comprising controlling operation of the fan to minimize a difference between a current measure of the temperature of the coolant and the set-temperature.

12. The method according to claim 1, comprising determining the measure indicative of a plurality of maximum engine oil temperatures:

after the vehicle reaches at least a minimum of mileage;

after the vehicle reaches at least a minimum velocity; and/or while the fan is being operated.

13. The method according to claim 1, wherein each driving cycle occurs according to at least one of: a predetermined operation schedule of the vehicle or a predetermined operation type of the vehicle.

14. A computer program product stored on a non-transitory computer-readable medium, said computer program product for controlling operation of a fan in a cooling system of a vehicle, wherein operation of the fan is controlled based on a temperature of a coolant in the coolant system of the vehicle meeting a set-temperature of the coolant, wherein said computer program product comprising computer instructions to cause one or more computing devices to perform the following operations:

monitoring, while the vehicle is operating, an engine oil temperature of an engine of the vehicle during a plurality of selected driving cycles of the vehicle;

determining a measure indicative of a plurality of maximum engine oil temperatures monitored during the plurality of driving cycles of the vehicle; and adjusting the set-temperature of the coolant for use in subsequent operation of the vehicle based on the measure indicative of a plurality of maximum temperatures of the engine oil monitored during the plurality of driving cycles of the vehicle.

15. A control arrangement for controlling operation of a fan in a cooling system of a vehicle, wherein operation of the fan is controlled based on a temperature of a coolant in the coolant system of the vehicle meeting a set-temperature of the coolant, and wherein the control arrangement is configured to:

monitor, while the vehicle is operating, an engine oil temperature of an engine of the vehicle during a plurality of selected driving cycles of the vehicle;

determine a measure indicative of a plurality of maximum engine oil temperatures monitored during the plurality of driving cycles of the vehicle; and adjust the set-temperature of the coolant for use in subsequent operation of the vehicle based on the measure indicative of a plurality of maximum temperatures of the engine oil monitored during the plurality of driving cycles of the vehicle.

16. A cooling system for a vehicle, wherein the cooling system comprises:

a fan;

a cooling circuit configured to circulate a coolant; and a control arrangement for controlling operation of the fan, wherein operation of the fan is controlled based on a temperature of a coolant in the coolant system of the vehicle meeting a set-temperature of the coolant, and wherein the control arrangement is configured to:

monitor, while the vehicle is operating, an engine oil temperature of an engine of the vehicle during a plurality of selected driving cycles of the vehicle;

determine a measure indicative of a plurality of maximum engine oil temperatures monitored during the plurality of driving cycles of the vehicle; and adjust the set-temperature of the coolant for use in subsequent operation of the vehicle based on the measure indicative of a plurality of maximum temperatures of the engine oil monitored during the plurality of driving cycles of the vehicle.

17. A vehicle comprising a cooling system, said cooling system comprising:

a fan;

a cooling circuit configured to circulate a coolant; and a control arrangement for controlling operation of the fan, wherein operation of the fan is controlled based on a temperature of a coolant in the coolant system of the vehicle meeting a set-temperature of the coolant, and wherein the control arrangement is configured to:

monitor, while the vehicle is operating, an engine oil temperature of an engine of the vehicle during a plurality of selected driving cycles of the vehicle;

determine a measure indicative of a plurality of maximum engine oil temperatures monitored during the plurality of driving cycles of the vehicle; and adjust the set-temperature of the coolant for use in subsequent operation of the vehicle based on the measure indicative of a plurality of maximum temperatures of the engine oil monitored during the plurality of driving cycles of the vehicle.

* * * * *